United States Patent [19]

Coffey et al.

[11] Patent Number: 4,790,906

[45] Date of Patent: Dec. 13, 1988

[54] METHOD FOR PRODUCING GLASS MAT USING GLASS HAVING A RELATIVELY HIGH ALKALI CONTENT

[75] Inventors: Fred S. Coffey, Newark, Ohio; Thomas W. Allen, Ripley, Tenn.; James E. Wille, Toledo, Ohio

[73] Assignee: Owens-Corning Fiberglas Corporation, Toledo, Ohio

[21] Appl. No.: 119,882

[22] Filed: Nov. 13, 1987

[51] Int. Cl.[4] ..... D21H 5/18

[52] U.S. Cl. ..... 162/156; 162/182

[58] Field of Search ..... 162/152, 156, 182

[56] References Cited

U.S. PATENT DOCUMENTS 4,532,006 7/1985 Winters et al. ..... 162/156

*Primary Examiner*—Peter Chin

*Attorney, Agent, or Firm*—Patrick P. Pacella; Ronald E. Champion; Catherine B. Martineau

[57] ABSTRACT

According to this invention there is provided a method for producing glass mat using glass having a relatively high alkali content which comprises chopping the glass fibers while wet and thereafter freezing the wet fiber glass in order to prevent leaching of the alkali constituents. The frozen glass fiber can then be crushed and used to prepare a glass fiber mat in a wet process.

3 Claims, No Drawings

METHOD FOR PRODUCING GLASS MAT USING GLASS HAVING A RELATIVELY HIGH ALKALI CONTENT

TECHNICAL FIELD

This invention relates to a method for producing glass fibrous mat using glass which has a relatively high alkali content. In particular, the invention comprises freezing wet chopped fibers made with a glass composition in order to stop the leaching process or migration of the soluble components of the glass to the flass surface. The freezing of the wet chopped glass fibers stops the leaching process yet leaves the fibers in a readily dispersible wet form once the fibers are thawed.

BACKGROUND OF THE INVENTION

The method of producing glass mat by the "wet-process" is well-known in the art. Glass fibers are placed in a water solution to produce a slurry. This slurry is mechanically agitated to disperse the glass fibers uniformly throughout the slurry. The solids content of this slurry is quite low, on the order of less than 1 percent. The slurry is applied to a moving screen, where, by means of a vacuum, a majority of the water is removed resulting in a continuous web of glass fibers. After formation of the web, a binder substance is applied to assist in bonding the fibers together. The bonded web is then passes through a dryer for evaporating any remaining water and for curing the binder.

Typically, type E glass is used in the production of glass fibrous mats. However, it would be advantageous to use type A glass since the A glass has a lower melting point than E glass, and thus less energy is consumed to melt A glass. Also, certain compositions of A glass contain constituents which are less expensive than the corresponding constituents in E glass. For Example, A glass typically contains alloys which are less expensive; such as less expensive alloys can be used since A glass has a lower melting point of E glass. However, there are several drawbacks to using A glass to produce glass mat using the "wet-process" method. A glass has a relatively high alkali content. During the "wetprocess" method of forming glass mat the alkali constituents have a tendency to leach from the glass. The leaching of the alkali constituents to the surface of the glass fiber causes the fibers to adhere or clump together, thus causing poor dispersion of fibers in the slurry.

There has now been invented an improved method for producing glass fibrous mat using relatively high alkali glass. This invention is directed to that improvement.

STATEMENT OF THE INVENTION

According to the present invention, glass fibers having a relatively high alkali content of, for example, greater than about 10%, by weight, alkali constituents, is used to produce glass fibrous mat. The A glass fibers are chopped while wet and then frozen and kept frozen until just prior to use on a wet process mat line. Various methods for freezing the wet fibers can be used. While such freezing processes are often used for fruit and vegetables, the applicant is not aware of any such process for use in aiding dispersion of glass fibers after forming or minimizing leaching problems.

According to this invention there is provided a method for improving the dispersion of glass fibers after forming which comprises freezing the wet fiber glass and thereafter crushing the frozen or partially thawed fiber glass and preparing glass fiber mat in a wet process.

In one embodiment of the invention, after the crushing of the frozen glass fibers, the glass fibers are formed into mats using a wet process similar to a paper making process, binder material is applied to the wet mat, the mat is cured and dried, and thereafter trimmed, rolled, packaged and shipped.

DESCRIPTION OF THE INVENTION

The method of this invention is applicable to any glass fibers, either individually or in the form of chopped strands. The methods of the invention is especially useful for high alkali glass fibers, such as A glass.

The method of this invention can use any method of freezing the glass fibers. In one embodiment, the wet chopped fibers are frozen within 24 hours of production and kept frozen until just prior to use on a wet process mat line. Various methods for freezing the wet fibers can be used. For example, a closed container with an internal temperature of about −20° F. to about 20° F. can be used for freezing the wet fibers. Common examples of such closed containers are deep freezers and freezer warehouses where the temperature is maintained at approximately 0° F. Another example of freezing includes a rapid method of freezing where wet fibers are sprayed with liquid nitrogen in order to stop the leaching process.

A typical method of carrying out the invention is illustrated by the following: The glass fibers are formed by known processes and an aqeous fiber sizing is applied to the formed glass. The wet fiber glass is chopped and thereafter frozen at approximately 0° F. into useable amounts. The frozen glass fibers can then be stored or shipped to a location for further processing.

Various batches of frozen chopped glass prepared according to the present invention were subjected to a mat forming process which includes crushing the frozen fiber glass and forming the mat. An initial input of frozen glass fiber having a dry weight of 500 lbs. (and a wet weight of 625 lbs.) were crushed off line to produce chunks having about a 2–3 inch diameter size or smaller chunks of frozen glass fibers. The chunks of frozen glass were allowed to thaw somewhat so that they were very soft and broken up easily. No dispersion problems were observed while running the crushed glass through the mat forming process. Nor was there an undesirable rise in pH levels due to leaching of the alkali constituents. A binder material was applied to the wet mat during the mat formation. The mat was thereafter dried and cured, thus forming a mat which is ready for trimming, rolling, packaging or shipping.

Frozen fiber as old as 5 months and as fresh as 5 days has been crushed and used in the mat process with no apparent effect on mat physical properties. Typically, frozen glass is removed from the freezer warehouse 24 to 48 hours prior to crushing and use in the mat process. The frozen glass is either kept in an unrefrigerated trailer or stored at ambient conditions in the mat facility during this 24–48 hour period. Even after 48 hours, the glass is still partially frozen. The dispersibility of fiber is excellent, regardly of whether hard frozen or soft frozen fiber was used.

The freezing of the fibers prevents the leaching of various alkali substituents from the glass fibers causing the pH of the slurry to rise. If the pH rises over about 8.5, poor dispersion results when the chopped glass fibers are used in a mat forming process. A lower pH, wherein less or little leaching occurs is desirable so that the dispersion of the glass fibers during the mat forming process is acceptable.

The glass fibrous mat made from the frozen chopped fibers displayed various desirable properties including the important physical properties such as fiber dispersion, mat tensile strength, thickness, mat weight per area, and color.

It will be evident from the foregoing that various modifications can be made to this invention. Such, however, are considered within the scope of the invention.

We claim:

1. A method for producing glass fibrous mat using glass fiber having an alkali content of about 10 percent, by weight, or greater, wherein the improvement comprises forming glass fibers, applying an aqueous fiber sizing, chopping the glass fibers while wet and thereafter lowering the temperature of the wet chopped fibers for a period of time sufficient to freeze the water in the sizing prior to placing the glass fibers in a water solution to slurry, dispersing the glass fibers uniformly throughout the slurry, and thereafter removing the water from the slurry to form a continuous mat of glass fibers.

2. The method of claim 1, wherein the wetted chopped fibers are frozen within 24 hours of production and are kept frozen until just prior to use on a wet process mat line.

3. The method of claim 1, in which the glass fibers are frozen to a temperature of about −20° F. to about 20° F.

* * * * *